United States Patent [19]

Stanley

[11] Patent Number: 4,756,813

[45] Date of Patent: Jul. 12, 1988

[54] SELF-BAKING ELECTRODE

[76] Inventor: Earl K. Stanley, 2790 Lynn Dr., Frederick, Md. 21701

[21] Appl. No.: 925,110

[22] Filed: Oct. 24, 1986

[51] Int. Cl.[4] ..... C25C 7/02

[52] U.S. Cl. ..... 204/286; 204/294; 373/89

[58] Field of Search ..... 204/294, 67, 286; 373/88, 89, 95, 97

[56] References Cited

U.S. PATENT DOCUMENTS

| | | | |
|---|---|---|---|
| 1,679,284 | 7/1928 | Westly et al. | 373/89 |
| 1,836,880 | 12/1931 | Sem | 373/97 |
| 2,193,434 | 4/1938 | Sem | 373/89 |
| 3,524,004 | 8/1970 | Van Nostran et al. | 373/89 |
| 3,697,660 | 10/1972 | Frolov et al. | 373/95 |
| 3,819,841 | 6/1974 | Persson | 373/89 |
| 4,457,002 | 6/1984 | Mathgen et al. | 373/95 |

*Primary Examiner*—John F. Niebling
*Assistant Examiner*—Kathryn Rubino
*Attorney, Agent, or Firm*—Berman, Aisenberg & Platt

[57] ABSTRACT

An electrode comprises an outer casing and an inner casing which enclose un-baked electrode paste. A conducting mandrel is placed in the center of the electrode and is in electrical contact with the paste. Electric current passes through the conducting mandrel outwardly through the paste to provide a baked electrode. Slipping shoes engage the outer surface of the baked electrode to support the baked electrode and the unbaked paste. In one embodiment, a thin foil moves with the paste to allow the paste to move downwardly easily with respect to the casings, and in a second embodiment, the casing is oscillated with respect to the paste to prevent adhesion between the paste and the casing walls.

26 Claims, 5 Drawing Sheets

FIG. 6a
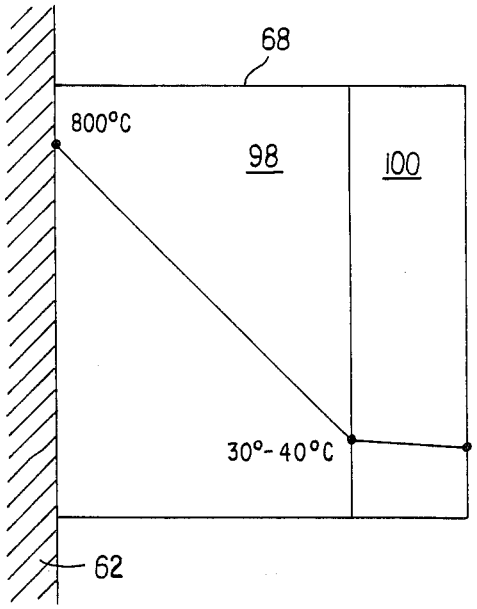
FIG. 6b
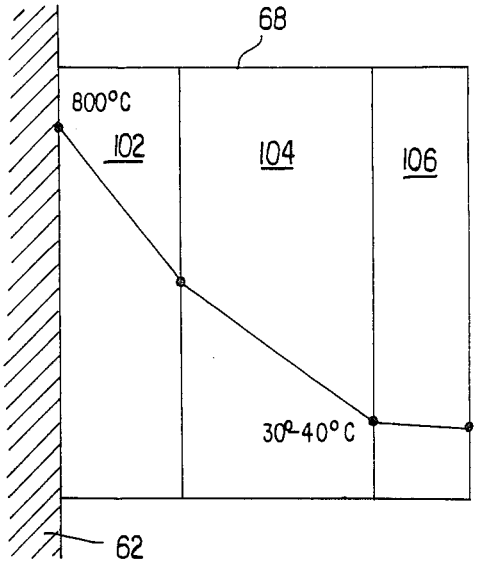
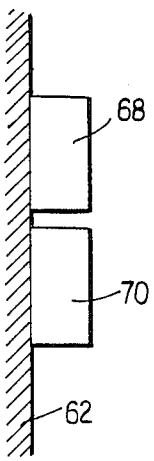
FIG. 7a
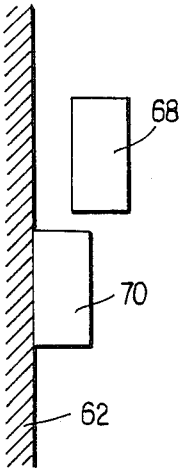
FIG. 7b
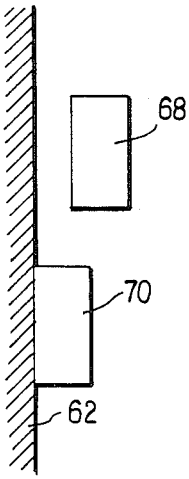
FIG. 7c
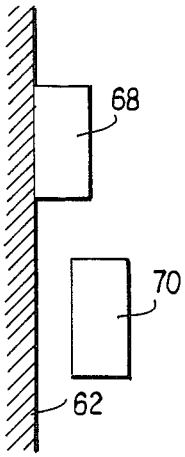
FIG. 7d
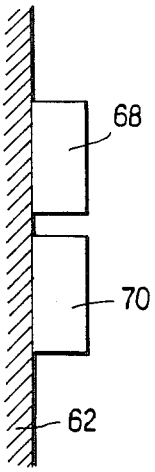
FIG. 7e

SELF-BAKING ELECTRODE

TECHNICAL FIELD

This invention relates to the art of self-baking electrodes.

BACKGROUND ART

In the production of metals, it is common to produce heat for the refining process by passing electric current through a charge of ore to permit a refining chemical reaction to take place. Electric current is introduced into the charge through an electrode which is in contact with the charge.

The electrode typically contains carbon and is decomposed slowly at the region of contact with the charge, thus requiring it to be slowly advanced as the refining reaction progresses. Many electrode designs have been suggested to provide an electrode of adequate size and which can be advanced into the charge. One such design is known as a self-baking electrode. In this type of electrode, an essentially continuous electrode is formed by allowing an electrode paste to be heated to bake the paste into a hard electrode which will conduct electricity into the charge.

One such known self-baking electrode is shown in FIG. 1. A tubular steel casing 2 contains electrode paste in an upper portion. Fins 4 extend radially inwardly from casing 2 to provide additional area to engage and support the electrode paste. The casing is supported at its upper end by slipping bands 6 which are in turn supported by a hydraulic jack 8 resting on beams 10. Electric current is introduced at a conducting band 12 which receives current through a conductor 14. Band 12 is urged against the outside surface of casing 2 by pressure ring 16 which is supported by arms 18. The paste is baked in baking zone 20 by the heat generated by the passage of current to produce a baked electrode at 22. Current flows from conducting band 12 into the furnace charge to heat it. Slipping bands 6 operate to lower the casing and electrode during the refining process as the baked electrode 22 is consumed.

As the electrode of FIG. 1 is advanced, the steel casing and steel fins melt and contaminate the ore being refined. When the ore is iron, such as in steel making, such is not unacceptable. On the other hand, in the making of other metals, such as silicon, the addition of iron is highly objectionable and severely limits the use toi which the electrode of FIG. 1 can be put in the production of silicon and other non-ferrous metals.

FIG. 2 shows another prior art self-baking electrode. A casing 24 is tubular and encloses paste 26. Vertical support is provided by a steel cable 28 having a plurality of steel bars 30 extending transversely through the cable to engage and support the unbaked paste. Slipping shoes 32 engage the outer surface of casing 24 to advance the electrode into the charge. Current is applied through conducting ring 34, and a baked electrode 36 is produced at the lower end.

Cable 28 is supported by a mechanism (not shown) which allows the center part of the electrode to be advanced at a rate faster than the advancement of the outer casing. In a typical installation, the inner electrode is advanced at a rate as much as 12 times greater than that of the outer casing.

The electrode of FIG. 2 has many disadvantages, such as the unstable control of the electrode due to the stretching of the steel cable and the contamination of the metal being refined by the melting of the steel cable and steel bars.

FIG. 3 is another example of a prior art self-baking electrode. An outer casing 38 encloses unbaked paste 40, and a graphite support electrode 42 extends along the length of the electrode to support the central electrode. In a manner similar to that described with respect to FIG. 2, the center electrode is advanced at a rate up to 12 times the rate of advancement of the outer casing. The outer casing is supported and advanced by shoes 44. Electricity is introduced at a conducting ring 46, and a baked electrode 48 is formed.

While the electrode of FIG. 3 does not suffer from the contamination problems discussed with respect to the electrodes of FIGS. 1 and 2, it is not practical to make the electrode of FIG. 3 in sufficient size for many furnaces in use today. The graphite support electrodes are typically machined from solid graphite, and electrodes of adequate diameter to produce a self-baking electrode of size sufficient to support commercial production of metal are extremely expensive.

U.S. Pat. No. 1,442,031 (Soderberg) shows yet another self-baking electrode. In this arrangement, a baked electrode portion is engaged by a support element, and a casing extending above the baked portion supports un-baked paste. The un-baked paste becomes baked by contact with heat from the furnace. In an embodiment shown in FIG. 2 of the Soderberg patent, electricity is introduced into the baked portion of the electrode through a centrally-located conductor. This electrode was never commercially successful and would suffer from several problems. For example, the only baking energy is from the furnace which would result in inadequate baking and would require a baked portion of substantial length.

Other prior art self-baking electrodes are shown in U.S. Pat. Nos. 3,524,004 (Van Nostran, et al.) and 1,640,735 (Soderberg).

SUMMARY OF THE INVENTION

In accordance with the invention, a self-baking electrode is provided which eliminates the prior art problem of contamination and which bakes the electrode paste by heat generated from passage of the furnace current through the paste.

A non-conducting outer casing encloses the electrode paste and a central tubular opening is maintained by an inner casing. A conducting mandrel is placed in the inner casing and is in electrical contact with the paste. The electrode is supported by slipping bands positioned below the conducting mandrel which engage the outer surface of the electrode. Paste is baked by the passage of current through it from the inner mandrel toward the outer surface of the electrode. The current density passing through the un-baked paste is sufficient to bake the paste to a substantially rigid condition by raising its temperature for a time sufficient to allow it to bake before it is advanced by slipping to the area contacted by the slipping bands.

The outer casing is preferably of rolled cardboard or other non-contaminating material which most simply burns away after contacting the high temperature of the furnace, but which does not contaminate the metal being produced even if it comes into contact with the ore being refined. The inner casing preferably comprises a metallic element of enough strength to withstand the radial forces generated by the weight of the paste and a thin metal foil for allowing the electrode paste to slip easily. The thin foil moves with the paste and is eventually melted in the furnace. Thin aluminum or steel is acceptable because contamination is slight.

In another embodiment, the paste is prevented from sticking by continual movement of the paste with respect to the casings.

The slipping bands are closely adjacent the furnace and are preferably cooled to prevent them from overheating. Advancement of the electrode by way of the slipping bands is accomplished in a series of steps known in the art.

The central opening in the baked electrode portion which results from the presence of the inner casing is preferably filled with coke, another reducing material, or with sand which may be introduced through a tube passing through the inner casing.

An object of this invention is to provide a self-baking electrode with markedly reduced contamination.

Another object of this invention is to provide a self-baking electrode wherein the energy for baking the electrode paste is provided by current passing from a central region of the paste to an outer region of the paste.

Still another object of this invention is to provide a self-baking electrode for a silicon metal furnace wherein contamination is substantially eliminated.

FIGS. *6a* and *6b* are cross-sections of a two embodiments of slipping bands showing temperature profiles.

Figure 1:
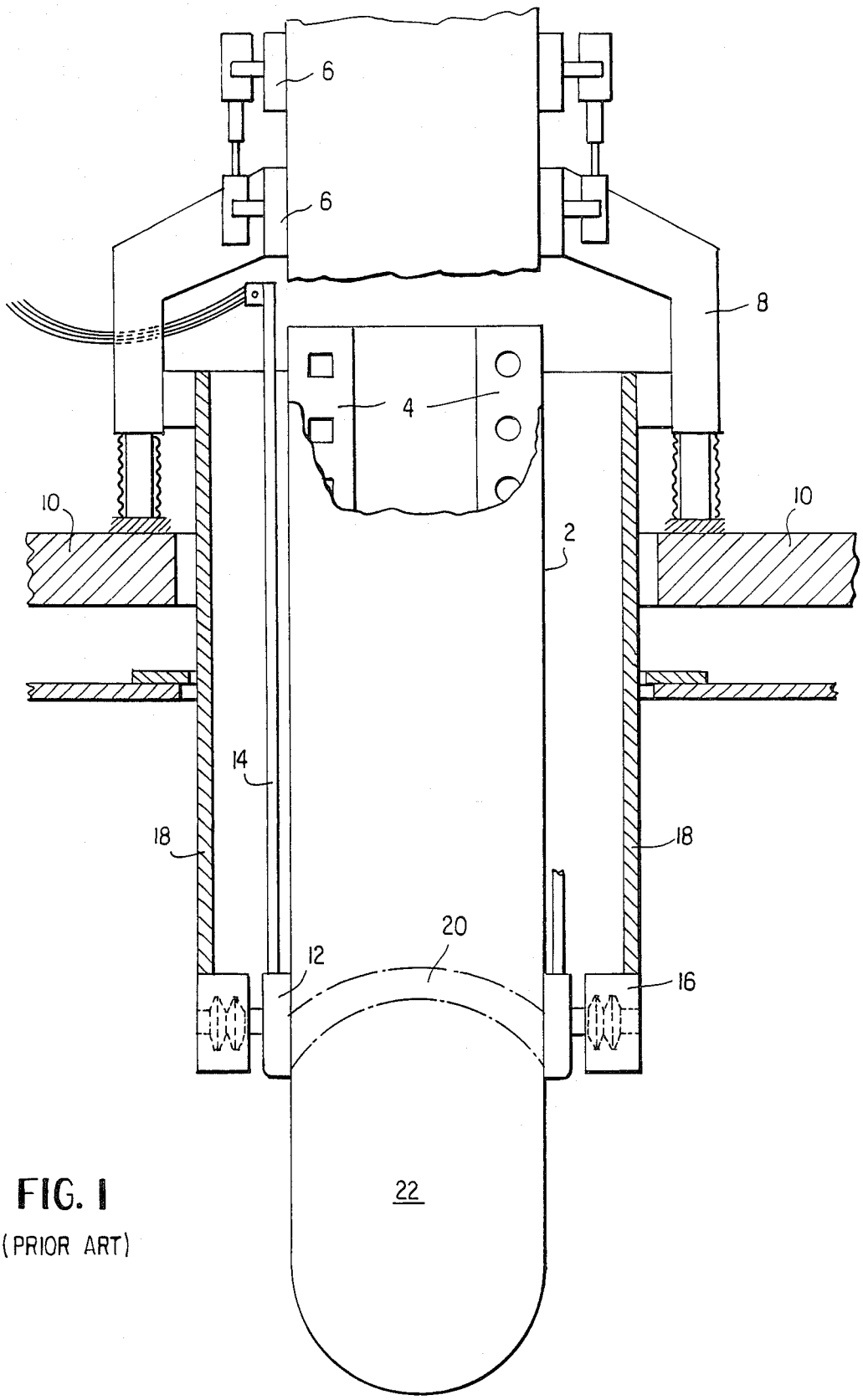
FIG. 1 (PRIOR ART)
FIGS. 1 through 3 are schematic diagrams of prior art electrodes.
Figure 2:
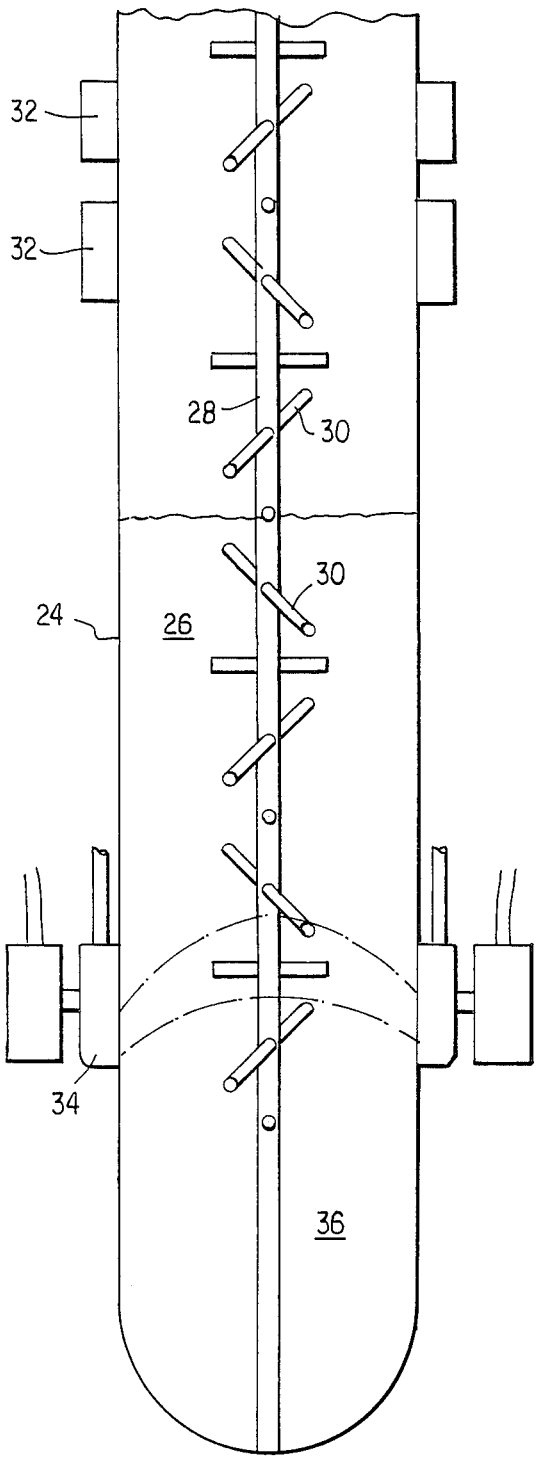
FIG. 2 (PRIOR ART)
Figure 3:
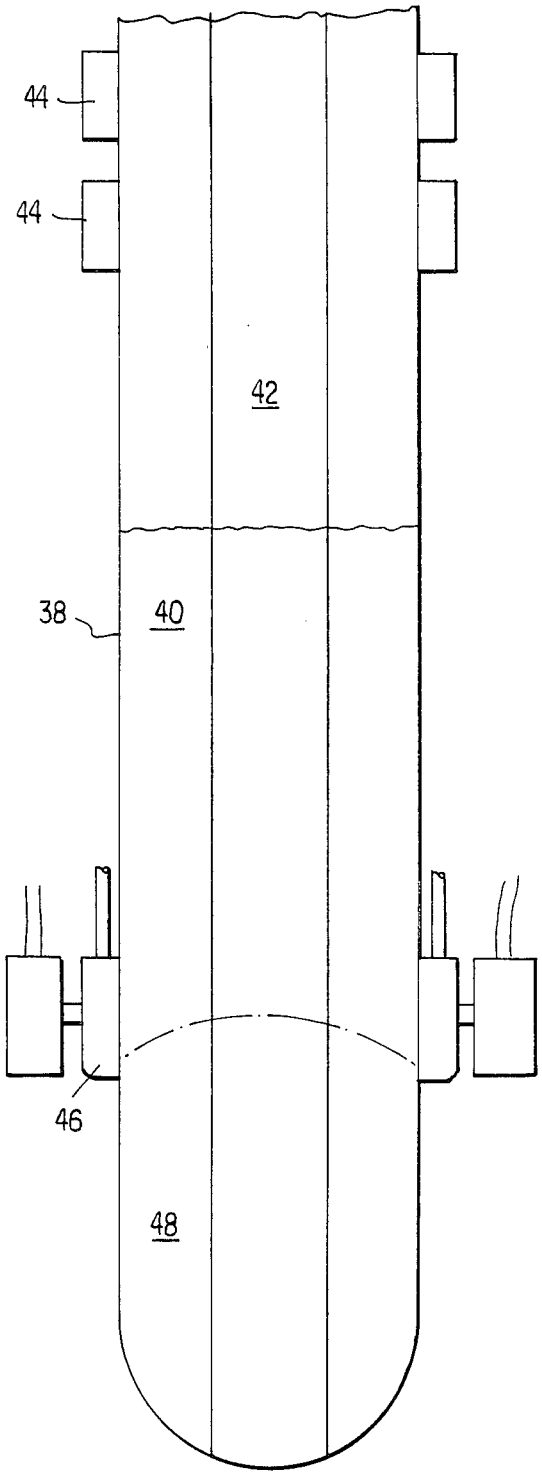
FIG. 3 (PRIOR ART)
Figure 4:
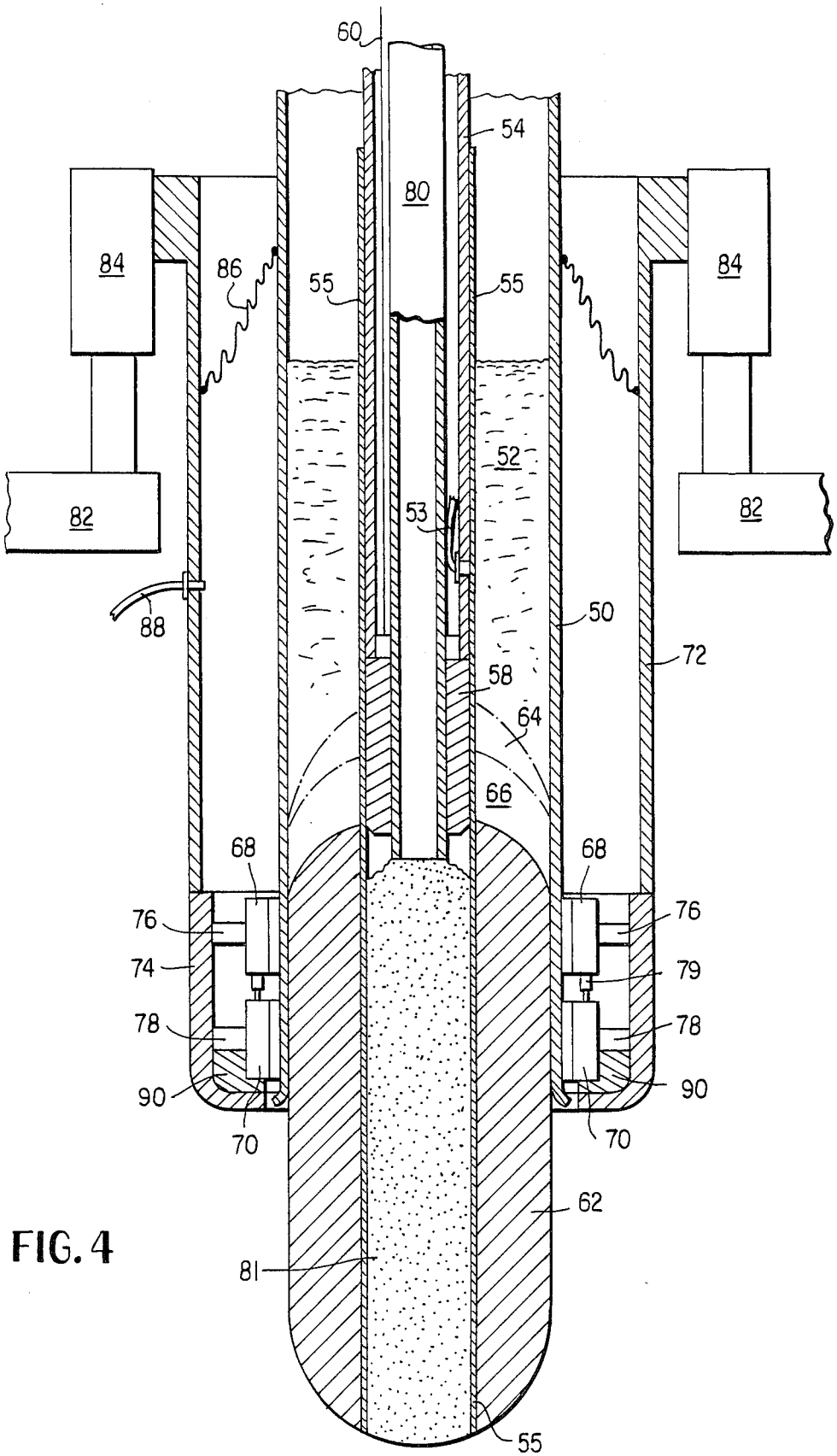
FIG. 4 is a longitudinal cross-section of a first embodiment of an electrode in accordance with the invention.
Figure 5:
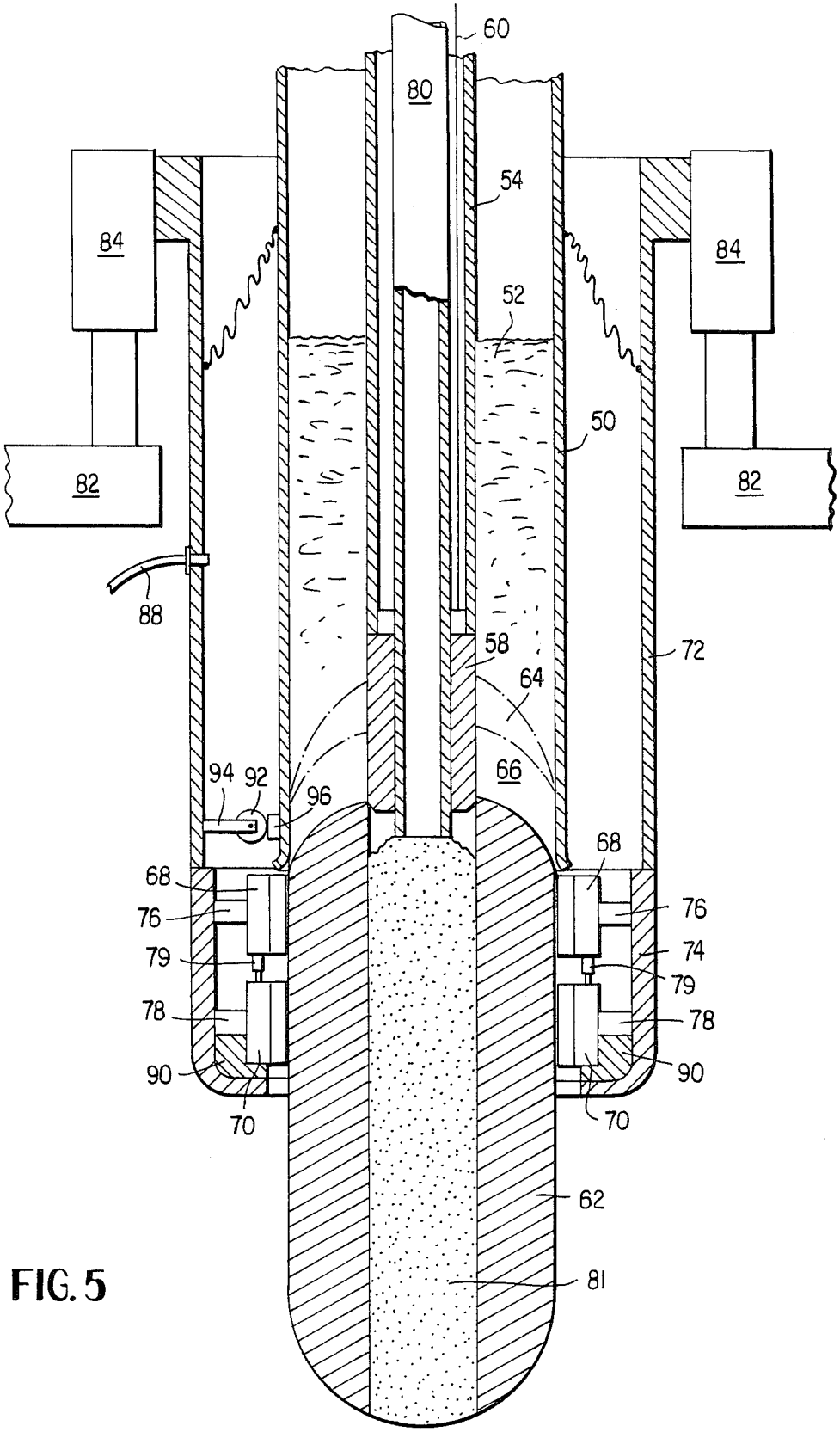
FIG. 5 is a longitudinal cross-section of a second embodiment of an electrode in accordance with the invention.

FIGS. *7a* through *7e* are schematic diagrams showing the operation of the slipping bands when advancing the electrode of FIGS. 4 or 5.

DETAILED DESCRIPTION OF THE INVENTION

FIG. 4 shows a longitudinal cross-section of a first embodiment of a self-baking electrode in accordance with the invention. An outer casing 50 and two inner casings 54 and 55 enclose self-baking paste 52. Outer casing 50 is preferably of cardboard or other non-conducting, non-contaminating material. Inner casing 54 is preferably of stainless steel having a thickness to withstand the forces generated by the unbaked paste. Preferably the height of the unbaked paste is at least about 100 inches to provide the necessary back pressure for furnace gases. To allow the paste 52 to move with respect to inner casing 54 more easily, a thin foil 55 of aluminum or steel is placed around casing 54. This foil moves with the paste and is eventually carried into the furnace and is consumed. Inert gas is introduced through hose 53 to provide a gas cushion between foil 55 and casing 54 to further ease relative motion. It will be appreciated from the description below that these materials may be used because of the unique design of the electrode wherein the casings do not support the entire weight of the electrode.

A conducting mandrel 58 is secured to the bottom of the inner casing 54, for example, by welding. Electric current is supplied to mandrel 58 by, for example, conductor 60 and passes through foil 55 and paste 52 to supply electric current to the furnace and to at least partially bake paste 52 to form a baked electrode 62.

Un-baked paste 52 is baked in regions 64 and 66 by the passage of current therethrough from conducting mandrel 58. Un-baked paste typically has an electrical resistance higher than that of partially baked or baked paste. Accordingly, in a region such as 64, the resistance is higher than that in region 66 because the degree of baking is less. As the paste 52 becomes more completely baked to form electrode 62, the electrical resistance decreases so that baked electrode 62 is cable of carrying a very large current with a low production of heat.

The substantial current passing through baking regions 64 and 66 at the higher electrical resistances of these regions produces substantial heat which is necessary to bake paste 52. Temperatures in the range of 400° C. during normal operation are to be expected in these regions.

Current flows outwardly from conducting mandrel 58 through regions 64 and 66 because of a phenomenon known as "skin effect." This phenomenon causes the major portion of the current which passes through substantially baked electrode 62 to be carried on its outer surface. Thus, current from conducting mandrel 58 naturally flows radially outwardly toward the outer portion of the electrode and forms baking regions 64 and 66.

The electrode is supported by a first set 68 of slipping shoes and a second set 70 of slipping shoes. As will be described below with respect to FIG. 7. The slipping shoes are movable to permit downward movement of the baked electrode 62. Sets of shoes 68 and 70 are supported by mantle 72 which terminates in a band 74. Shoes 68 are attached to band 74 by hydraulic elements 76, and shoes 70 are attached to band 74 by hydraulic elements 78. Shoes 68 and 70 are attached to each other by hydraulic actuators 79 to allow slipping of the baked electrode 62 as will be described below.

It will be appreciated that sets of shoes 68 and 70 engage the electrode at the baked electrode region 62. This baked electrode is substantially rigid and is capable of withstanding the radially inwardly directed forces created by hydraulic elements 76 and 78 necessary to grasp the electrode tightly enough to support the weight of the baked electrode 62, the casings 50 and 54, and the unbaked paste 52. Because baking may be total only after the electrode has been in the furnace, the electrode 62 may not be technically completely baked. Electrode 62 is, however, baked enough to provide a rigid element for grasping and to have a high conductivity.

A water-cooled feed chute 80 extends along the axis of the electrode to a location near that of conducting mandrel 58. In the embodiment shown in FIG. 4, the feed chute extends to a point just beyond the conducting mandrel. The feed chute permits introduction of coke 81, or equvalent material, to fill the hole in the center of baked electrode 62 created by the presence of mandrel 58. This prevents penetration of furnace gases above the mandrel which would cause excessive heating. Coke is preferred because it is non-contaminating, and equivalent materials will be apparent to those of skill in the art. If the feed chute is conductive it may be used in place of conductor 60 to supply mandrel 58 with current. Also, casing 54 may be used, if desired.

Mantle 72 is supported by steel beams 82, and stands 84 serve as intermediate elements between the mantle 72 and the steel beams. These stands may be vertically adjustable.

A first gas seal 86 extends between the mantle 72 and the outer casing 50. Inert gas (such as Nitrogen) is introduced through hose 88 to fill the region between mantle 72 and casing 50 with the inert gas under a slight pressure. Seal 86 prevents the gas from escaping upwardly, and this causes a small amount of the gas to emerge from the small space between the bottom of mantle 72 and the outer surface of baked electrode 62. This prevents the furnace gases from contacting shoes 68, 70 and their associated support structure. Preferably, a fibrous gas seal 90 extends around the bottom of mantle 72 to assist in preventing furnace gases from flowing upwardly into the electrode support structure.

FIG. 5 shows a second embodiment of an electrode in accordance with the invention. Like elements have been identified by the reference numbers of FIG. 4.

The electrode of FIG. 5 employs a unique oscillation technique to prevent adherence of the paste to the inner and outer casings. In this embodiment, casing 50 terminates above shoes 68 and the two sets of shoes 68, 70 engage the outer surface of at least partially baked electrode 62 directly. Because casing 50 does not engage the furnace and does not melt or burn, it may be made of stainless steel or the like. An actuating cylinder 92 is mounted to mantle 72 by bracket 94 and to outer casing 50 by bracket 96. Actuating cylinder 92 applies a force to casing 50 through bracket 96 in a direction tangential to casing 50 to drive casing 50 in rotation with respect to mantle 72. Inner casing 54 and mandrel 58 are physically connected to casing 50 but are electrically insulated therefrom. Outer casing 50 and inner casing 54 are preferably oscillated continuously, and this oscillation prevents paste 52 from sticking to inner casing 54 or to outer casing 50. Thus, slippage is greatly facilitated.

Actuating cylinder 92 may be a hydraulic cylinder or other known actuating means. Preferably, the degree of oscillation is such that outer casing 50 moves 3 to 4 inches circumferentially while inner cylinder 54 moves about 1 inch circumferentially. Also, any number of actuating cylinders may be used. Preferably, at least three are used to distribute the forces.

The oscillation provided in the electrode of FIG. 5 reduces the adherence between the paste and the casings to such an extent that foil 55 and hose 53 of the electrode of FIG. 4 may be eliminated.

FIGS. *6a* and *6b* show temperature profiles of shoes 68 or 70.

As shown in FIG. *6a* the shoes may comprise a first section 98 of a material capable of withstanding high temperatures. For example, a material such as a Cermet would be acceptable. A second section 100 is water cooled to reduce the temperature to which the supporting structure such as elements 76 and 78 are subjected. The temperature at the electrode-engaging surface of portion 98 is about 800° C., and this decreases to 30° to 40° C. at the interface with the water cooled section 100.

FIG. *6b* shows a three-part shoe wherein a section 102 of material such a Cermet is bonded to a section 104 of, for example, stainless steel. The stainless steel portion 104 is in turn bonded to water cooled section 106. The temperature decreases rapidly in the section 102 to a level which will not damage stainless section 104, and the temperature is then further reduced to the 30°–40° temperature at the interface with water cooled section 106.

FIGS. *7a* through *7e* show how shoes 68 and 70 are operated to advance the baked electrode into the furnace. In a first position as shown in FIG. *7a*, the shoes 68 and 70 engage electrode 62. Then, as shown in FIG. *7b*, shoe 68 is moved outwardly to a position where it does not engage electrode 62. Then, electrode 70 is moved downwardly by operation of actuators 79 to lower electrode 62 by a predetermined amount. Then, shoe 68 again engages electrode 62 as shown in FIG. *7d*, and shoe 70 moves first away from electrode 62 and then upwardly to its initial position with respect to shoe 68. As shown in FIG. *7e*, shoe 70 is then re-engaged with electrode 62 which has now been moved downwardly by the predetermined amount.

A significant advantage provided by the invention is that the baking rate of the electrode is increased so that it exceeds the usage rate. This is significant because prior art electrodes often bake at a rate less than the rate of usage, requiring the furnace to be shut down while the electrode is placed in a "baking mode" to replenish lost electrode material. Experiments have shown that an electrode in accordance with the invention can produce 4.5 to 5 inches of electrode per hour, and that far exceeds the rule-of-thumb requirement of 2.5 inches per hour.

It will be appreciated that a unique electrode has been described. Modifications within the scope of the appended claims will be apparent to those of skill in the art.

What is claimed is:

1. An electrode comprising means for containing unbaked electrode paste, conductor means located within said means for containing and adapted to conduct electric current into said paste for transmission through said unbaked electrode paste to at least partially bake said paste to form a rigid electrode, support means for engaging said rigid electrode at a location below said conductor means to support said unbaked electrode paste, and current supply means for supplying furnace electric current to a furnace for operation of said furnace, said current supply means being connected to said conductor means in such a manner that substantially all of said furnace electric current is directed to said conductor means.

2. An electrode according to claim 1 wherein said support means comprises means for advancing said at least partially baked electrode paste in a direction away from said conductor means.

3. An electrode according to claim 2 wherein said support means comprises slipping bands.

4. An electrode according to claim 1 wherein said means for conducting electric current comprises a mandrel in electrical contact with said unbaked electrode paste.

5. An electrode according to claim 1 wherein said means for containing unbaked electrode paste comprises an outer casing of electrically non-conductive material.

6. An electrode according to claim 5 wherein said means for containing unbaked electrode paste further comprises an inner casing of electrically conductive material.

7. An electrode according to claim 6 wherein said inner casing and said outer casing are tubular.

8. An electrode according to claim 6 wherein said electrically non-conductive material comprises rolled cardboard.

9. An electrode according to claim 6 wherein said electrically conductive material is steel or aluminum.

10. An electrode according to claim 5 further comprising slipping band means for supporting said unbaked electrode paste and said at least partially baked paste and for selectively advancing said unbaked and at least partially baked paste wherein said slipping bands are located below said conductor means and wherein said outer casing is located between said slipping band means and said at least partially baked electrode whereby said outer casing is advanced with said at least partially baked paste.

11. An electrode according to claim 10 wherein said conductor means comprises an inner casing extending into said unbaked paste and further including a conductive foil between said inner casing and said unbaked paste, said foil being movable with said unbaked paste with respect to said inner casing.

12. An electrode according to claim 11 wherein said foil is of aluminum.

13. An electrode according to claim 1 further comprising hood means surrounding said means for containing for providing an enclosure containing an inert gas.

14. An electrode according to claim 1 wherein said means for containing comprises an outer casing surrounding an inner casing and further comprising means for continuously moving at least one of said outer and inner casings with respect to said unbaked paste without advancing said rigid electrode.

15. An electrode according to claim 14 wherein said means for moving comprises means for continuously reciprocally moving said outer casing and said inner casing with respect to said at least partially baked paste.

16. An electrode in accordance with claim 14 wherein said slipping bands engage said at least partially baked paste.

17. A method for making an electrode of at least partially baked electrode paste comprising providing unbaked electrode paste and at least partially baking said paste to form a rigid electrode by introducing substantially all of the electric current for operation of an electric furnace into a central region of said unbaked electrode paste to heat and bake said unbaked electrode paste by the passage of said current therethrough.

18. A method according to claim 17 further comprising the step of supporting said unbaked electrode paste by engaging said at least partially baked paste at a location below said unbaked paste and below said central region.

19. A method according to claim 17 further comprising the step of advancing said at least partially baked electrode paste into an electric furnace.

20. An electrode according to claim 6 wherein said inner casing comprises a first inner casing connected to said conductor means and a second inner casing between said first inner casing and said unbaked paste and movable with said paste with respect to said first inner casing.

21. An electrode according to claim 20 further comprising means for supplying a fluid under pressure between said first and second inner casings to facilitate movement of said second inner casing with respect to said first inner casing.

22. An electrode comprising an outer casing at least partially surrounding an inner casing and forming an enclosure for unbaked electrode paste therebetween, wherein said inner casing comprises a first inner casing and a second inner casing for contacting and moving with said electrode paste, said electrode further comprising means for supplying a fluid under pressure between said first and second inner casings to facilitate movement of said second inner casing with respect to said first inner casing.

23. An electrode comprising an outer casing at least partially surrounding an inner casing to form an enclosure for containing electrode paste, and means for continuously moving at least one of said inner and outer casings with respect to said electrode paste while maintaining fixed the axial position of said paste with respect to said inner and outer casings.

24. An electrode according to claim 23 comprising means for engaging an at least partially baked portion of said paste and wherein said means for moving is connected between said means for engaging and said inner and outer casings.

25. An electrode according to claim 24 wherein said inner and outer casings are connected for simultaneous movement with respect to said electrode paste.

26. An electrode according to claim 25 wherein said means for continuously moving comprises an hydraulic cylinder.

* * * * *